US006610153B1

(12) United States Patent
Lohr et al.

(10) Patent No.: US 6,610,153 B1
(45) **Date of Patent: *Aug. 26, 2003**

(54) CLEANING AGENTS FOR POSTRETICULATING POLYURETHANE HOT MELTS

(75) Inventors: Christoph Lohr, Dortmund (DE); Michael Krebs, Hilden (DE)

(73) Assignee: Henkel Kommanditsellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,996

(22) PCT Filed: Apr. 20, 1998

(86) PCT No.: PCT/EP98/02323

§ 371 (c)(1),
(2), (4) Date: Jan. 10, 2000

(87) PCT Pub. No.: WO98/49262

PCT Pub. Date: Nov. 5, 1998

(30) Foreign Application Priority Data

Apr. 29, 1997 (DE) ..... 197 18 065

(51) Int. Cl.[7] ..... C11D 3/44
(52) U.S. Cl. ..... 134/38; 510/174; 510/202
(58) Field of Search ..... 134/2, 12, 36, 134/42, 38; 510/174, 202, 212, 240, 242, 243, 244, 413, 493, 505

(56) References Cited

U.S. PATENT DOCUMENTS

| | | | | | |
|---|---|---|---|---|---|
| 3,647,531 | A | * | 3/1972 | Matsushita et al. | |
| 4,056,403 | A | | 11/1977 | Cramer et al. | 134/22 R |
| 4,219,508 | A | * | 8/1980 | Wagner | |
| 4,276,352 | A | * | 6/1981 | Green | |
| 4,293,690 | A | * | 10/1981 | Sawa et al. | |
| 4,327,214 | A | * | 4/1982 | Rentzea et al. | |
| 4,374,250 | A | * | 2/1983 | Hirashima et al. | |
| 4,393,216 | A | * | 7/1983 | Hirashima et al. | |
| 4,425,266 | A | * | 1/1984 | Beck et al. | |
| 4,532,262 | A | | 7/1985 | Gloskey | 521/127 |
| 4,552,879 | A | * | 11/1985 | Ishikawa et al. | |
| 4,675,126 | A | | 6/1987 | Unger et al. | 252/153 |
| 4,996,359 | A | * | 2/1991 | Kesling, Jr. et al. | |
| 5,030,685 | A | * | 7/1991 | Doi | |
| 5,073,287 | A | * | 12/1991 | Harelstad | |
| 5,270,431 | A | * | 12/1993 | Blum | |
| 5,346,640 | A | * | 9/1994 | Leys | |
| 5,348,680 | A | | 9/1994 | Maitz | 252/162 |
| 5,415,799 | A | | 5/1995 | Maitz | 252/162 |
| 5,772,790 | A | * | 6/1998 | Huber | |
| 6,117,404 | A | * | 9/2000 | Mimura et al. | |
| 6,207,235 | B1 | * | 3/2001 | Ohsawa et al. | |

FOREIGN PATENT DOCUMENTS

| | | | |
|---|---|---|---|
| DE | 59 670 | | 1/1968 |
| DE | 72 964 | | 5/1970 |
| DE | 132 675 | | 10/1978 |
| DE | 154 446 | | 3/1982 |
| EP | 0 188 833 | | 7/1986 |
| EP | 0 544 058 | | 6/1993 |
| JP | 56155271 | A * | 12/1981 |
| SU | 1 694 609 | | 11/1991 |

OTHER PUBLICATIONS

Database WPI, AN92–355916, XP002072150 (Composition for Removing Polymeric Coating).

* cited by examiner

*Primary Examiner*—Gregory E. Webb
(74) *Attorney, Agent, or Firm*—Stephen D. Harper; Daniel S. Ortiz

(57) ABSTRACT

A cleaning composition effective for removing reactive polyurethane hotmelts and reaction products thereof is presented containing (a) a non-volatile monohydroxy compound having a boiling point at normal pressure of greater than 140° C., a monoamine, or mixtures thereof, and (b) a catalyst for the production of a polyurethane or a depolymerization catalyst selected from the group consisting of an alkali metal alcoholate, an alkaline earth metal alcoholate, an aluminum alcoholate, a tertiary amine and mixtures thereof. The cleaning composition removes both residues of the reactive uncrosslinked hotmelt and also adhering deposits of already reacted, crosslinked or cracked, infusible hotmelt.

15 Claims, No Drawings

CLEANING AGENTS FOR POSTRETICULATING POLYURETHANE HOT MELTS

This application is filed under 35 U.S.C. 371 and based on PCT/EP98/02323, filed Apr. 20, 1998.

BACKGROUND OF THE INVENTION

1. Field of the Invention

This invention relates to a cleaning composition for removing reactive polyurethane hotmelts and reaction products thereof from production and processing equipment.

2. Description of Related Art

The use of post-crosslinking polyurethane hotmelts (hotmelt adhesives), especially for industrial applications, is now very widespread because these adhesives combine the advantages of the quick setting of conventional non-post-crosslinking hotmelt adhesives with the better heat resistance of reactive adhesives. Reactive polyurethane hotmelts contain reactive groups which are capable of further reacting by crosslinking with the moisture in the surrounding air or in the substrates to be joined. These moisture-reactive functional groups are generally isocyanate groups although they may also be alkoxysilane groups.

In order to prevent premature crosslinking of these reactive hotmelts during production and processing, the production and processing equipment are encapsulated against the penetration of moisture. In addition or alternatively, they are blanketed with dry inert gases to prevent moisture from entering. Despite these precautionary measures, moisture cannot be prevented from gradually diffusing into the production and processing equipment so that crosslinking, infusible compounds are formed by the reaction of the reactive hotmelts with that moisture. In addition, cracking products can be formed in the event of prolonged residence times of the hotmelts in the processing unit and, in many cases, lead not only to a reduction in molecular weight but also (for example through the trimerization of isocyanate groups) to an increase in molecular weight, i.e. to the formation of products which can no longer be melted.

The formation of these crosslinked, infusible polyurethanes or polyureas and polyisocyanates in the processing unit is extremely troublesome to the processor:

The processing unit can become "blocked". The feed lines and application nozzles of narrow cross-section are particularly affected. Since the throughflow rates change, the application parameters have to be reset.

The formation of a skin is an obstacle to heat transfer, for example in melting tanks or in a production reactor. This means longer heating times, losses of energy and additional heating of the melt through longer residence times.

In the processing of the hotmelt, the pieces of skin and lumps of already hardened polyurethane hotmelt thus formed are often carried over into the product stream so that the application nozzle can become at least partly blocked. This is extremely critical in the case of slot nozzles and spray heads. In their case, blockages can lead to interruptions during application which results in faulty bonds. Since application of the adhesive and, in many cases, fitting together of the components are carried out automatically, these faulty bonds only come to light through the operational failure of the component.

In addition, specks also appear in the adhesive film after application of the polyurethane hotmelt and, for example in the case of lamination bonding for parts of the interior trim of automobiles, can lead to an unattractive appearance, to an unpleasant feel and possibly to operational failure through mechanical stressing in the adhesive joint as a result of the non-planarity.

Accordingly, both manufacturers of reactive polyurethane hotmelts and processors of these adhesives are obliged to regularly wash and clean production and application machinery. Hitherto, solvents for example, such as xylene, or even solvents containing a terminator, i.e. monofunctional solvents which react with the reactive terminal groups, including alcohol-containing solvents, have been used for this purpose. However, solvents can only be used in explosion-proof equipment and in production areas with so-called ex-protection. In addition, cleaning with solvents is incomplete and laborious because the hardened or cracked products are largely insoluble and only swell so that they have to be partly removed mechanically.

Attempts have also been made to avoid the above-mentioned difficulties caused by solvents by using so-called cleaning compounds. Known cleaning compounds are pastes which do not react chemically with the hotmelt adhesive and which, in the apparatus to be cleaned, mix with the adhesive residues to be removed and only dilute and displace them. Corresponding cleaning compounds include, for example, nonreactive hotmelt adhesives, for example based on mixtures of EVA polymers and a resin component. However, EVA polymers do not mix well with standard polyurethane hotmelts. In addition, the hotmelt adhesive, on account of its still reactive isocyanate functionality, is capable of further reaction in the mixture to form crosslinked products which are very difficult to remove because they are infusible and substantially insoluble in the cleaning compound and can therefore collect in inaccessible places in the production and processing machinery.

Cleaning compounds based on nonreactive hotmelts with an added monofunctional chain terminator, for example an alcohol, are used as an alternative. Corresponding cleaning hotmelts have long been commercially available, for example from Henkel under the name of "Reinigungshotmelt Q 1950". EP-A-55 058 also discloses cleaning compounds for removing reactive polyurethane hotmelt adhesives from production and processing machinery and equipment which contain at least one reactive monofunctional hydroxy compound capable of reacting with the isocyanates of the hotmelt adhesive and optionally added components, such as resins, waxes, plasticizers and the like. This ensures that the remaining isocyanate groups of the polyurethane hotmelt are saturated and no unwanted further crosslinking can occur during the cleaning process. In practice, however, the equipment is much more difficult to clean because the above-mentioned crosslinked products already present as a result of moisture or trimerization reactions or cracking cannot be dissolved even by these cleaning compounds. Accordingly, this already crosslinked material has to be mechanically removed as far as possible, the time and effort involved in the cleaning process being considerable on account of the sometimes very poor accessibility of the parts. This cleaning problem is therefore often used as an important argument against the use of reactive polyurethane hotmelts because the time and expense involved in the cleaning process is considerable compared with the use of thermoplastic, non-chemically post-crosslinking hotmelts and, at the same time, the availability of the application unit is limited on account of the time-consuming cleaning operation.

Accordingly, the problem addressed by the present invention was to provide a cleaning composition for reactive polyurethane hotmelts which would remove not only residues of the reactive uncrosslinked hotmelt but also adhering deposits of the already reacted, crosslinked or cracked, infusible hotmelt.

DESCRIPTION OF THE INVENTION

According to the invention, this problem has been solved by cleaning compositions containing non-volatile monohydroxy compounds and depolymerization catalysts.

The monohydroxy compound prevents crosslinking of the reactive isocyanate groups and, hence, the formation of infusible reaction product. The use of non-volatile monohydroxy compounds enables these cleaning compounds to be used even in production/processing units which have not been protected against explosions.

The depolymerization catalyst present in the cleaning compound according to the invention chemically degrades the already reacted, crosslinked or cracked infusible components of the hotmelt so that even deposits such as these in the production/processing units can be quickly and easily removed. The cleaning composition according to the invention effects the chemical degradation by trans-urethanization in the case of polyether urethanes and also polyisocyanurates. In the case of hotmelts based on polyester urethanes, transesterification of the polyester also takes place. In view of the large number of ester bonds in the molecule, chemical degradation to very low molecular weight compounds and hence low-viscosity compounds is particularly advantageous.

As already mentioned, the cleaning composition according to the invention contains two key components, namely a non-volatile or low-volatility monohydroxy compound. Non-volatile or low volatility monohydroxy compounds in the context of the invention are monohydroxy compounds which have a boiling point at normal pressure of >140° C., preferably >160° C. and more preferably >200° C. In general, these monohydroxy compounds have a flash point of >100° C. Examples of such monohydroxy compounds are the $C_{6-24}$ monoalcohols which are marketed by Henkel KGaA under the name of "Lorol". The saturated fatty alcohol mixture Lorol C12/C14 is most particularly preferred. Other examples of monohydroxy compounds suitable for use in accordance with the invention are benzyl alcohol, alkyl benzyl alcohols, abietyl alcohol, nonylphenol, polyethylene glycol monoalkyl ethers, polypropylene glycol monoalkyl ethers and mixtures thereof. Secondary monoamines, optionally in combination with the above-mentioned hydroxy compounds, may also be used.

According to the invention, suitable depolymerization catalysts are in principle any of the catalysts known from polyurethane chemistry as catalysts for the production of the polymers and known esterification catalysts. Examples of such catalysts are alcoholates, more especially alkali metal alcoholates such as, for example, sodium methylate, sodium ethylate, sodium isopropylate and alcoholic solutions thereof. The sodium alcoholates may of course be replaced by the corresponding potassium compounds or alkali metal or aluminium compounds. According to the invention, other suitable depolymerization catalysts are the organotin compounds known per se of divalent and/or tetravalent tin such as, for example, tin(II) carboxylates or dialkyl tin(IV) dicarboxylates such as, for example, tin(II) octoate or dibutyl tin diacetate, dibutyl tin dilaurate (DBTL) or dibutyl tin maleate. In addition, other organometallic compounds such as, for example, 1,3-dicarbonyl compounds of iron such as, for example, iron(III) acetylacetonate and, more particularly, organometallic compounds of titanium, such as titanium tetraalkylates, more particularly the readily accessible titanium tetraisopropylate, may be used. The tertiary amines known as polyurethane catalysts may also be used for depolymerization.

Sodium methylate and, above all, titanium tetraisopropylate and dibutyl tin dilaurate (DBTL) are particularly preferred.

To change their solidification point and/or to modify their flowability, the cleaning compositions according to the invention may also contain nonreactive components such as, for example, nonreactive hotmelt adhesive constituents, such as thermoplastics, resins, waxes and, in particular, plasticizers. Low-volatility, saponification-resistant plasticisers in particular, such as for example Mesamoll (a product of Bayer AG) or Lipinol T (a product of Hüls), may be added in order to improve the flowability of the cleaning compositions at room temperature.

The following Examples are intended to illustrate the invention without limiting it in any way.

Strips of cured polyurethane hotmelt were first prepared by applying 3 mm thick layers of the hotmelts commercially available under the names of Macroplast QR 2530-21 (polyester urethane) and Macroplast QR 6265-21 (polyether urethane) from Henkel KGaA and curing them in air for 4 weeks. The cured polyurethane hotmelt layers were then cut into strips.

EXAMPLE 1

The saturated fatty alcohol mixture Lorol C12/C14 (Henkel KGaA) was introduced into an Erlenmeyer flask equipped with a magnetic stirrer. 1% by weight, based on the alcohol mixture, of dibutyl tin dilaurate was then added and the mixture was heated to 120° C. Strips of cured polyurethane hotmelt (10% by weight, based on the cleaning mixture) were then placed in the mixture.

EXAMPLE 2

The procedure was as in Example 1, except that the DBTL was replaced by sodium methylate.

EXAMPLE 3

The procedure was as in Example 1 except that titanium tetraisopropylate was used as the depolymerization catalyst.

EXAMPLES 4 TO 6

The procedure was as in Examples 1 to 3 except that the mixture was heated to 140° C.

COMPARISON EXAMPLES 1 AND 2

The procedure was as in Examples 1 and 4 except that no polymerization catalyst was added.

The test results are set out in the following Tables.

TABLE 1

Examples 1 to 3 and Comparison Example 1
Temperature: 120° C.

| | |
|---|---|
| Comparison 1 | Only partly dissolved to a paste after 4 hours; residues of cured material in the flask. Evaluation: – |
| Example 1 | Completely dissolved to a paste after t < 4 h. Evaluation: + |

TABLE 1-continued

| Examples 1 to 3 and Comparison Example 1 Temperature: 120° C. | |
|---|---|
| Example 2 | Small residues of cured material after 4 h. Evaluation: o |
| Example 3 | Completely dissolved to a paste after 4–6 h. Evaluation: + |

TABLE 2

| Examples 4 to 6 and Comparison Example 2 Temperature: 140° C. | |
|---|---|
| Comparison 2 | Only partly dissolved to a paste after 4 hours; residues of cured material in the flask. Evaluation: – |
| Example 4 | Completely dissolved to a paste after t < 4 h. Evaluation: + |
| Example 5 | Completely dissolved to a paste; color brown. Evaluation: + |
| Example 6 | Completely dissolved to a paste after t < 4 h. Evaluation: + |

Evaluation:
– unsatisfactory
o acceptable
+ very good degradation

As can be seen from the above Table, the reaction mixtures corresponding to the prior art, which do not contain a depolymerization catalyst, react much more slowly. However, a particular disadvantage is that chemical degradation is not complete and that residues of cured material remain in the mixture.

Using the cleaning compositions according to the invention which contain a depolymerization catalyst, the cured residues of polyester and polyether urethanes can be completely dissolved by the cleaning mixture at low temperatures (120 to 140° C.). The crosslinked polyurethanes are partly dissolved by the liquid components. A mixture with a paste-like, readily pumpable and transportable consistency is formed. The temperatures used correspond to normal reactive hotmelt application temperatures so that they are also readily available in application and processing equipment.

As can be seen from the above test results, sodium methylate is very effective at relatively high temperatures, although tin compounds (DBTL) and titanium tetraisopropylate—which has a very high dissolving rate even at low temperatures (120° C.)—are particularly effective.

After application of the described cleaning composition, the production and processing machinery and equipment have to be rinsed with a nonreactive compound in order completely to remove residues of the monoalcohol and the catalyst.

What is claimed is:

1. A process for cleaning production and processing machinery containing reactive polyurethane hotmelts and reaction products thereof, comprising contacting such machinery with a cleaning composition comprising (a) at least one compound selected from a group consisting of a non-volatile or low-volatility monohydroxy compound having a boiling point at normal pressure greater than 140° C., or a secondary monoamine, or mixtures thereof; and (b) at least one polyurethane depolymerization catalyst.

2. The process of claim 1 wherein such polyurethane depolymerizalion catalyst is selected from the group consisting of alkali metal alcoholates, alkaline earth metal alcoholates, aluminum alcoholates, tertiary amine catalysts for the production of polyurethanes, other catalysts for the production of polyurethanes or polyesters, and mixtures thereof.

3. The process of claim 1 wherein such monohydroxy compound is selected from the group consisting of $C_{6-24}$ monoalcohols, benzyl alcohol, alkyl benzyl alcohols, abietyl alcohol, nonylphenol, polyethylene glycol monoalkyl ether, polypropylene glycol monoalkyl ether and mixtures thereof.

4. The process of claim 1 wherein such monohydroxy compound has a boiling point of greater than 160° C. at normal pressure.

5. The process of claim 1 wherein such mononydroxy compound has a flash point of greater than 100° C. at normal pressure.

6. The process of claim 1 wherein such polyurethane depolymerization catalyst is selected from the group consisting of organotin compounds of divalent tin or tetravalent tin or mixtures thereof, alkali metal alcoholates, titanium tetraalkylates, and mixtures thereof.

7. The process of claim 1 wherein such polyurethane depolymerization catalyst comprises sodium methylate, titanium tetraisopropylate or dibutyl tin dilaurate or a mixture thereof.

8. The process of claim 1 wherein said cleaning composition further comprises a low-volatility, saponification-resistant plasticizer, resin, wax or mixtures thereof.

9. A process for cleaning production and processing machinery containing reactive polyurethane hotmelts and reaction products thereof, comprising contacting such machinery with a cleaning composition comprising (a) at least on compound selected from a group consisting of a non-volatile or low-volatility monohydroxy compound having a boiling point at normal pressure greater than 140° C., or a secondary monoamine, or mixtures thereof; and (b) at least one polyurethane depolymerization catalyst selected from the group consisting of organotin compounds of divalent tin or tetravalent tin or mixtures thereof, alkali metal alcoholates, titanium tetraalkylates, tertiary amine catalysts for the production of polyurethanes, and mixtures thereof.

10. The process of claim 9 wherein such monohydroxy compound is selected from the group consisting of $C_{6-24}$ monoalcohols, benzyl alcohol, alkyl benzyl alcohols, abietyl alcohol, nonylphenol, polyethylene glycol monoalkyl ether, polypropylene glycol monoalkyl ether and mixtures thereof.

11. The process of claim 9 wherein such monohydroxy compound has a boiling point of greater than 160° C. at normal pressure.

12. The process of claim 9 wherein such monohydroxy compound has a flash point of greater than 100° C. at normal pressure.

13. The process of claim 9 wherein such polyurethane depolymerization catalyst is selected from the group consisting of organotin compounds of divalent tin or tetravalent tin or mixtures thereof, alkali metal alcoholates, titanium tetraalkylates, and mixtures thereof.

14. The process of claim 9 wherein such polyurethane depolymerization catalyst comprises sodium methylate, titanium tetraisopropylate or dibutyl tin dilaurate or a mixture thereof.

15. The process of claim 9 wherein said cleaning composition further comprises a low-volatility, saponification-resistant plasticizer, resin, wax or mixtures thereof.

* * * * *

UNITED STATES PATENT AND TRADEMARK OFFICE

CERTIFICATE OF CORRECTION

PATENT NO. : 6,610,153 B1
DATED : August 26, 2003
INVENTOR(S) : Lohr et al.

It is certified that error appears in the above-identified patent and that said Letters Patent is hereby corrected as shown below:

Column 5,
Line 66, delete “depolymerization” and insert therfore -- depolymerization --.

Column 6,
Line 14, delete “mononydroxy”, and insert therefore -- monohydroxy --.
Line 32, delete “on”, and insert therefore -- one --.

Signed and Sealed this

Twenty-eighth Day of September, 2004

JON W. DUDAS
*Director of the United States Patent and Trademark Office*